US005584516A

United States Patent [19]

Cetnar

[11] Patent Number: 5,584,516

[45] Date of Patent: Dec. 17, 1996

[54] V-LINK RELEASE MECHANISM FOR AUTOMOBILE DOOR LATCHES

[75] Inventor: Roman Cetnar, Newmarket, Canada

[73] Assignee: Atoma International Inc., Markham, Canada

[21] Appl. No.: 537,416

[22] Filed: Oct. 27, 1995

Related U.S. Application Data

[63] Continuation of Ser. No. 248,645, May 25, 1994, abandoned.

[51] Int. Cl.[6] ..... E05B 3/00

[52] U.S. Cl. ..... 292/336.3; 292/DIG. 65

[58] Field of Search ..... 292/336.3, DIG. 65, 292/DIG. 41, DIG. 62, 196

[56] References Cited

U.S. PATENT DOCUMENTS

| | | | |
|---|---|---|---|
| 2,270,559 | 1/1942 | Rolph et al. . | |
| 2,804,330 | 8/1957 | Ogley . | |
| 2,869,912 | 1/1959 | Becker, Jr. et al. | 292/336.3 |
| 3,848,909 | 11/1974 | Foley | 292/336.3 X |
| 4,283,155 | 8/1981 | Yamazaki et al. | 292/336.3 X |
| 4,796,934 | 1/1989 | Kesel et al. | 292/DIG. 62 X |
| 4,995,654 | 2/1991 | Nishigami et al. | 292/DIG. 65 X |
| 5,035,528 | 7/1991 | Thau . | |
| 5,069,493 | 12/1991 | Mochida et al. | 292/336.3 |

FOREIGN PATENT DOCUMENTS

| | | | |
|---|---|---|---|
| 3907674 | 9/1989 | Germany | 292/DIG. 65 |
| 3-119277 | 5/1991 | Japan | 292/336.3 |
| 1422394 | 7/1976 | United Kingdom . | |

*Primary Examiner*—Rodney M. Lindsey
*Attorney, Agent, or Firm*—Cushman, Darby & Cushman; IP Group of Pillsbury; Madison & Sutro LLP

[57] ABSTRACT

A vehicle door is provided including a latching mechanism carried by the door constructed and arranged to move between an unlatched relation with a door opening catch and a latched relation with the door opening catch. The latching mechanism includes a movable releasing component constructed and arranged to be in a latching position within the door structure when the latching mechanism is in latched relation with the door opening catch and to be moved from the latching position in a generally downward direction into a releasing position to move the latching mechanism into unlatched relation with the door opening catch. A motion-transmitting assembly is disposed within a space defined by the door to transmit a manual motion of an external door handle to downward motion of the movable releasing component. The motion transmitting assembly is constructed and arranged so that an accidental forward deformation of the door defining the space, sufficient to displace the motion-transmitting assembly, will displace an interconnection with the movable releasing component generally upwardly so that the latching mechanism remains in its latched relation with the door opening catch.

13 Claims, 3 Drawing Sheets

V-LINK RELEASE MECHANISM FOR AUTOMOBILE DOOR LATCHES

This is a continuation of application No. 08/248,645, filed on May 25, 1994, which was abandoned upon the filing hereof.

BACKGROUND OF THE INVENTION

This invention relates to a vehicle door construction and, more particularly, to improvements in the latching and release hardware embodied in a vehicle rear door.

A conventional latch and release hardware for a vehicle rear door is shown in FIG. 1, which is a side elevational view of a rear portion of a rear door structure 10 having a window frame 11 and wheel arch 12. The door structure 10 defines an interior space 13. A door latching mechanism 14 is mounted to a latch mount surface 16 of the door structure 10. The latching mechanism 14 is mounted so as to move between an unlatched relation with a door opening catch or striker assembly (not shown) and a latched relation with the door opening catch. The latching mechanism 14 includes a movable releasing component 18 disposed in a latching position within the door structure 10 when the latching mechanism 14 is in latched relation with the door opening catch and is movable from the latching position in a generally downward direction into a releasing position, to move the latching mechanism into an unlatched relation with the door opening catch.

A manually operable exterior latch releasing assembly is mounted on the door structure 10 and has a handle member (not shown) which is disposed outwardly of an exterior panel of the door structure, within a recessed portion 20 thereof. Fixed to the handle member is a component 22 disposed in the space 13 within the door structure 10 and movable from an inoperative position in a generally downward direction into a releasing position in response to manual movement of the handle member from an inoperative position to a release position. A motion transmitting mechanism, generally indicated at 24, is disposed within the space 13 of the door structure 10 and includes a handle rod 26 coupled between the handle component 22 and a lever 28. Lever 28 has a pivot 32 fixed to the door structure 10 in the position shown in FIG. 1. A latch release rod 30 is coupled between the releasing component 18 and the lever 28. To release the latching mechanism 14 from the door opening catch, the handle member is manually lifted which causes the handle component 22 to move downwardly. The motion-transmitting mechanism 24 transmits the generally downward movement of handle component 22 to a generally downward movement of the releasing component 18 from its latching position to its releasing position, permitting the door structure 10 to open.

A vehicle rear door utilizing the conventional motion-transmitting mechanism 24 is susceptible to malfunction during an accidental offset rear impact. Thus, in an offset rear impact directed in the direction of arrow D, the door structure sheet metal at the latch mounting surface 16 may collapse moving the rear wheel arch 12 forward so as to be disposed in the position indicated by dashed-line 34 of FIG. 1. This movement carries with it the fixed pivot 32 of the lever 28. Consequently, the connections of the rods 26 and 30 with the lever 28 will cause the lever 28 to assume a position shown by the dashed lines in FIG. 1. Since pivot 32 of the lever 28 moves from point A to point B, the latch release rod 30 moves downwardly, thus moving the releasing component 18 generally downwardly, releasing the latching mechanism 14 from engagement with the door opening catch, permitting the door to open.

The construction and arrangement of the conventional motion-transmitting mechanism 24 is undesirable since during an accidental offset rear impact, an occupant may be thrown from the rear passenger compartment of the vehicle through the open door.

SUMMARY OF THE INVENTION

An object of the present invention is to provide a vehicle door including a latching mechanism and a releasing assembly which is constructed and arranged to ensure that upon an accidental impact, the vehicle door will remain in a latching position. In accordance with the principles of the present invention, this objective is obtained by providing a vehicle door including a door structure defining an exterior skin and an interior panel, the door structure being constructed and arranged to be pivoted at a forward end thereof and moved between open and closed positions with respect to a door opening in the vehicle, a latching mechanism carried by the door structure at a rear end portion thereof constructed and arranged to move between an unlatched relation with a door opening catch and a latched relation with the door opening catch. The latching mechanism includes a movable releasing component constructed and arranged to be in a latching position within the door structure when the latching mechanism is in latched relation with the door opening catch and to be moved from the latching position in a generally downward direction into a releasing position to move the latching mechanism into unlatched relation with the door opening catch. The vehicle door includes a manually operable releasing assembly mounted on the door structure at the rear end thereof having a manually engageable movable component disposed outwardly of the exterior skin constructed and arranged to be manually engaged and moved from an inoperative position into a releasing position. The releasing assembly includes a moving component disposed within the door structure movable from an inoperative position in a generally downward direction into a releasing position in response to the manual movement of the releasing assembly from the inoperative position thereof into the releasing position thereof. A motion-transmitting assembly is interconnected between a portion of the moving component and a generally horizontally spaced portion of the movable releasing component for transmitting the generally downward movement of the moving component from its inoperative position to its releasing position into a generally downward movement of the movable releasing component from its latching position into its releasing position. The motion-transmitting assembly is disposed within an interior space defined by the door structure which extends below the interconnections of the motion-transmitting assembly between the moving component and the movable releasing component. The motion-transmitting assembly is constructed and arranged within the space so that an accidental forward deformation of the door structure defining the space sufficient to displace the motion-transmitting assembly will displace the interconnection with the movable releasing component generally upwardly so that the latching mechanism remains in its latched relation with the door opening catch.

Another object of the present invention is to provide a latching and releasing assembly for mounting in a vehicle door that is constructed and arranged to ensure that upon an accidental impact, the vehicle door will remain in a latching position. In accordance with the principles of the present invention, this objective is obtained by providing a latching and releasing assembly for a vehicle door, the vehicle door defining a door structure having an exterior skin and an interior panel, the door structure being constructed and arranged to be pivoted at a forward end thereof and moved between open and closed positions with respect to a door opening in the vehicle. The assembly includes a latching mechanism constructed and arranged to be carried by the door structure at the rear end thereof and to be moved between an unlatched relation with a door opening catch and a latched relation with the door opening catch, the latching mechanism including a movable releasing component constructed and arranged to be moved from a latching position, in a generally downward direction, into a releasing position to move the latching mechanism into unlatched relation with the door opening catch; a manually operable releasing assembly constructed and arranged to be mounted on the door structure at the rear end thereof and having a manually engageable movable component constructed and arranged to be disposed outwardly of the exterior skin, the manually engageable movable component being constructed and arranged to be manually engaged and moved from an inoperative position into a releasing position. The releasing assembly includes a moving component constructed and arranged to be disposed within the door structure and movable from an inoperative position in a generally downward direction into a releasing position in response to the manual movement of the releasing assembly from the inoperative position thereof into the releasing position thereof. A motion-transmitting assembly is interconnected between a portion of the moving component and a generally horizontally spaced portion of the movable releasing component for transmitting the generally downward movement of the moving component from its inoperative position to its releasing position into a generally downward movement of the movable releasing component from its latching position into its releasing position. The motion-transmitting assembly is constructed and arranged to be disposed within an interior space defined by the door structure which extends below the interconnections of the motion-transmitting assembly between the moving component and the movable releasing component. The motion-transmitting assembly is also constructed and arranged so that when arranged within the space, an accidental forward deformation of the door structure defining the space sufficient to displace the motion-transmitting assembly will displace the interconnection with the movable releasing component generally upwardly.

Another object of the present invention is the provision of a vehicle door and a latching and releasing assembly of the type described which are simple in construction, effective in operation and economical to manufacture and maintain. These and other objects of the present invention will become apparent during the course of the following detailed description and appended claims.

DETAILED DESCRIPTION OF THE INVENTION

Figure 1:
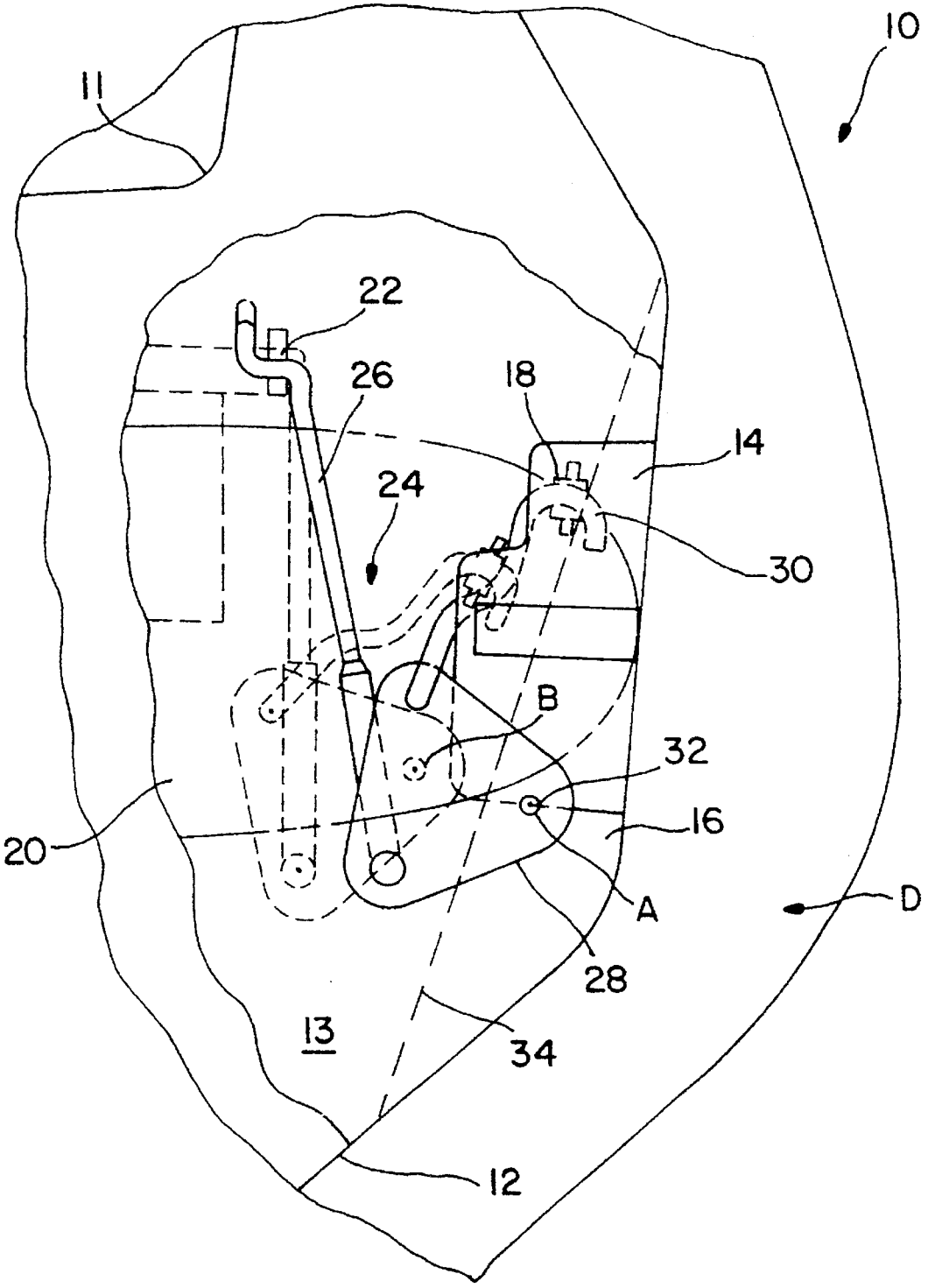
FIG. 1 PRIOR ART
FIG. 1 is a partial side elevational view of vehicle rear door including a conventional, prior art latching and releasing assembly, shown with a portion of the door interior panel removed for clarity of illustration.
Figure 3:
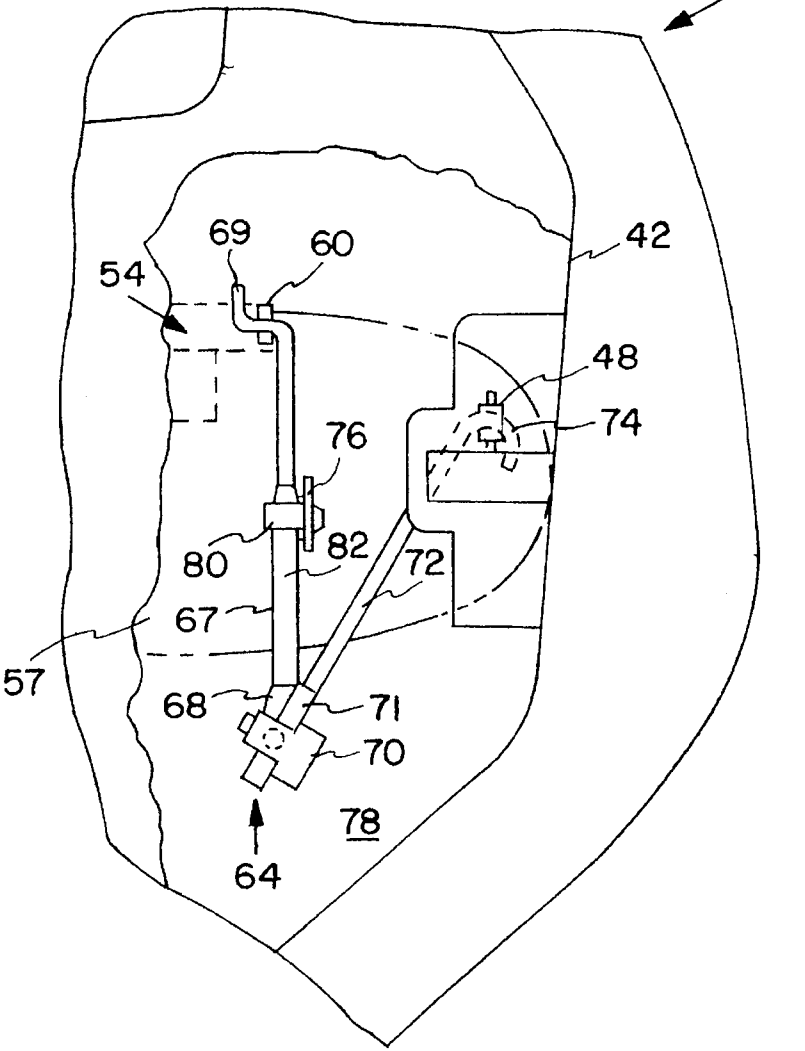
FIG. 3 is a partial side elevational view of the vehicle rear door of FIG. 2, shown with the latching mechanism disposed in a releasing position.

Referring to the drawings, particularly to FIGS. 2–5, a rear portion of a vehicle rear door is shown including a door structure 40 defining an exterior skin panel 42 and an interior panel 44. The door structure 40 is constructed and arranged to be pivoted at a forward end thereof and move between open and closed positions with respect to a door opening in a motor vehicle.

A latching mechanism 46 is carried by the door structure 40 at the rear end thereof. The latching mechanism 46, of any conventional construction, is arranged to move between an unlatched relation with a door opening catch (not shown) and a latched relation with the door opening catch.

Figure 4:
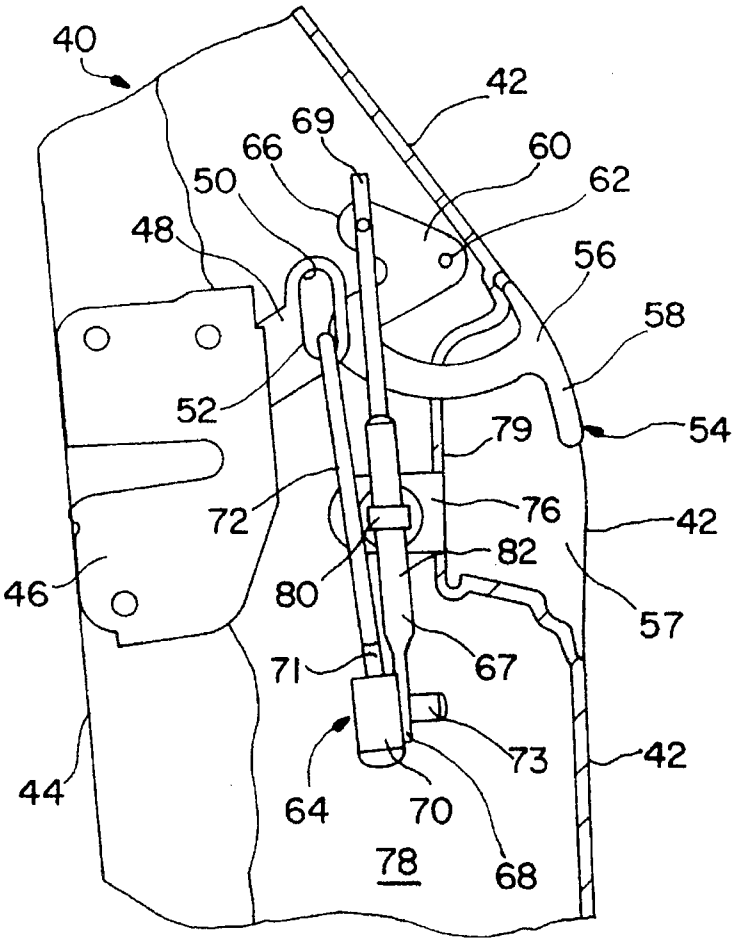
FIG. 4 is a partial front elevational view of the vehicle rear door of FIG. 2, shown with a portion of a door panel removed for clarity of illustration, with the latching mechanism disposed in a latching position.

The latching mechanism 46 includes movable releasing component 48 extending therefrom for releasing the latching mechanism from engagement with the door opening catch. The releasing component 48 includes surfaces 50 defining an elongated slot portion 52 (FIG. 4). The releasing component 48 is movable from a latching position (FIG. 4) within the door structure 40 when the latching mechanism 46 is in latched relation with the door opening catch, in a generally downwardly direction, into a releasing position (FIG. 5), to move the latching mechanism 46 into an unlatched relation with the door opening catch.

Figure 5:
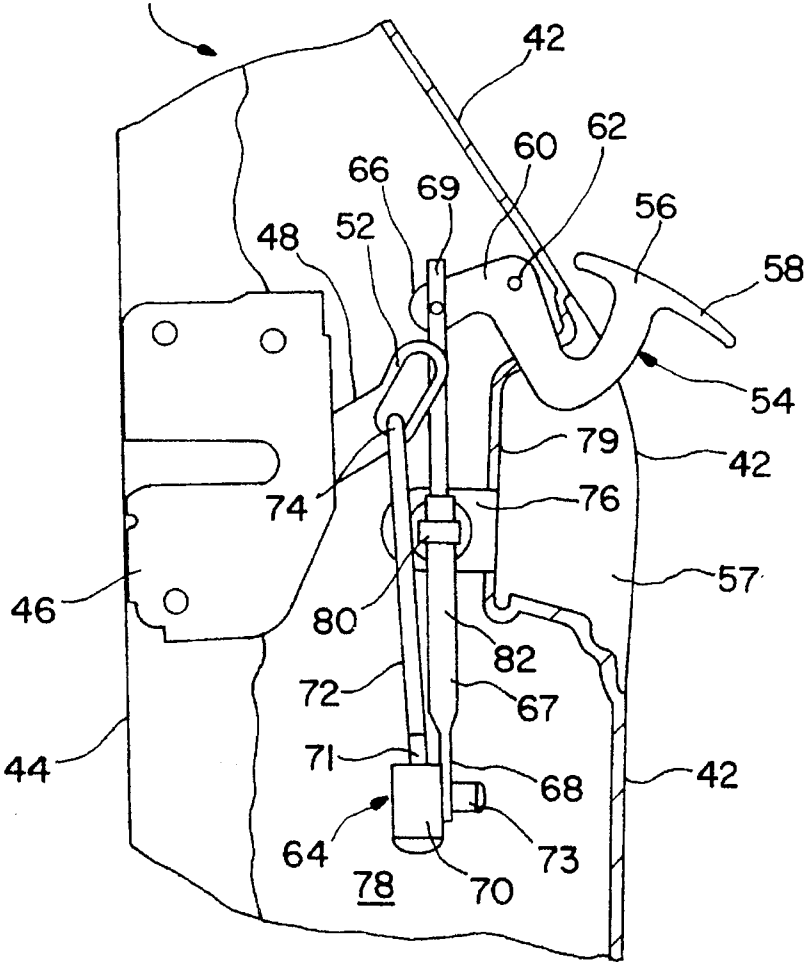
FIG. 5 is a partial front elevational view of the vehicle rear door of FIG. 4, with the latching mechanism disposed in a releasing position.

A manually operable releasing assembly, generally indicated at 54, is mounted on the door structure 40 at the rear end thereof. As best shown in FIGS. 4 and 5, the releasing assembly 54 includes a manually movable exterior handle component 56 which is disposed outwardly of the exterior panel 42, within recess 57. In the illustrated embodiment, the handle component 56 includes a downwardly extending portion 58 defining a surface for engaging and manually moving the handle component 56 from an inoperative position (FIG. 4) in a generally upward direction to a releasing position (FIG. 5).

The releasing assembly 54 includes a moving component 60 disposed within the door structure 10 and pivotally mounted thereto at pivot 62. The moving component 60 is movable from an inoperative position (FIG. 4), in a generally downward direction, into a releasing position (FIG. 5) in response to manual, generally upward movement of the releasing assembly 54 from the inoperative position thereof into the releasing position thereof.

It is within the contemplation of the invention that the handle component 56 may be of any desired configuration which transmits a manual movement thereof to downward movement of a component thereof. Thus, manual movement of the releasing assembly 54 may be in directions other than generally vertical.

A motion-transmitting assembly, generally indicated at 64, defining a V-link structure, is interconnected between end portion 66 of moving component 60 and the slot portion 52 of the releasing component 48, which is horizontally spaced from the moving component 60 within the door structure 10. The motion transmitting assembly 64 includes a handle release rod 67 coupled to end portion 66 of the moving component 60 at end 69 thereof. End 68 of the handle release rod 67 is pivotally coupled to a coupling member or adjusting clip 70 of latch release rod 72. The adjusting clip 70 may be of any conventional configuration which permits adjustment of the coupling point between rods 67 and 72. In the illustrated embodiment, the adjusting clip 70 is preferably of two part plastic construction forming a hollow, generally cylindrical member having internal threads. The two parts of the clip 70 are snapped together over the externally threaded end 71 of the latch release rod 72. Thus, the internal threads of the clip 70 engage the externally threaded end 71 of rod 72. The adjusting clip 70 also includes a projecting portion 73 which engages with end 68 of the handle release rod 67 so as to pivotally couple rod 72 to rod 67. The adjusting clip 70 may be snapped into engagement with rod 72 at any point along threaded end 71 thereof so as to adjust the coupling point of rod 72 and rod 67. It can be appreciated that alternatively, rod 67 may be provided with a threaded end so as to cooperate with the clip 70 while the end of rod 72 may be configured to accept projecting portion 73.

Hooked end 74 of the latch release rod 72 is engaged with the releasing component 48 at the slot portion 52.

The handle release rod 67 is supported on the door structure 40 at support tab 76, which is coupled to the door structure 40 forward the exterior panel 42, extending within an interior space 78, as shown in FIG. 4. Thus, support tab 76 is mounted forward of the exterior skin portion 79 which defines the extent of the recess 57, which receives handle component 56. As shown in FIG. 4, exterior skin portion 79 is disposed forward of exterior panel 42.

The interior space 78 is defined by the door structure 40 and extends below the interconnections of the motion transmitting assembly 64, between the moving component 60 and the releasing component 48. The support tab 76 includes a projecting portion 80 which slidably receives the periphery of portion 82 of the handle release rod 67 to support the motion transmitting assembly 64 within space 78. Thus, the projecting portion permits supported, reciprocating movement of the handle release rod 67.

With reference to FIGS. 2 to 5, when handle component 58 is manually moved in a generally upward direction, the moving component 60 of the releasing assembly 54 rotates about pivot 62, causing end portion 66 to move downwardly permitting portion 82 of the handle release rod 67 to slide downwardly within the projecting portion 80 of the support tab 76. The downward motion of the motion transmitting assembly 64 is transmitted to the releasing component 48 of the latching mechanism 46 via latch release rod 72, pivotally coupled to rod 67, which moves the releasing component 48 downwardly from its latching position into its releasing position, moving the latching mechanism 46 into its unlatched relation with the door opening catch.

Figure 2:
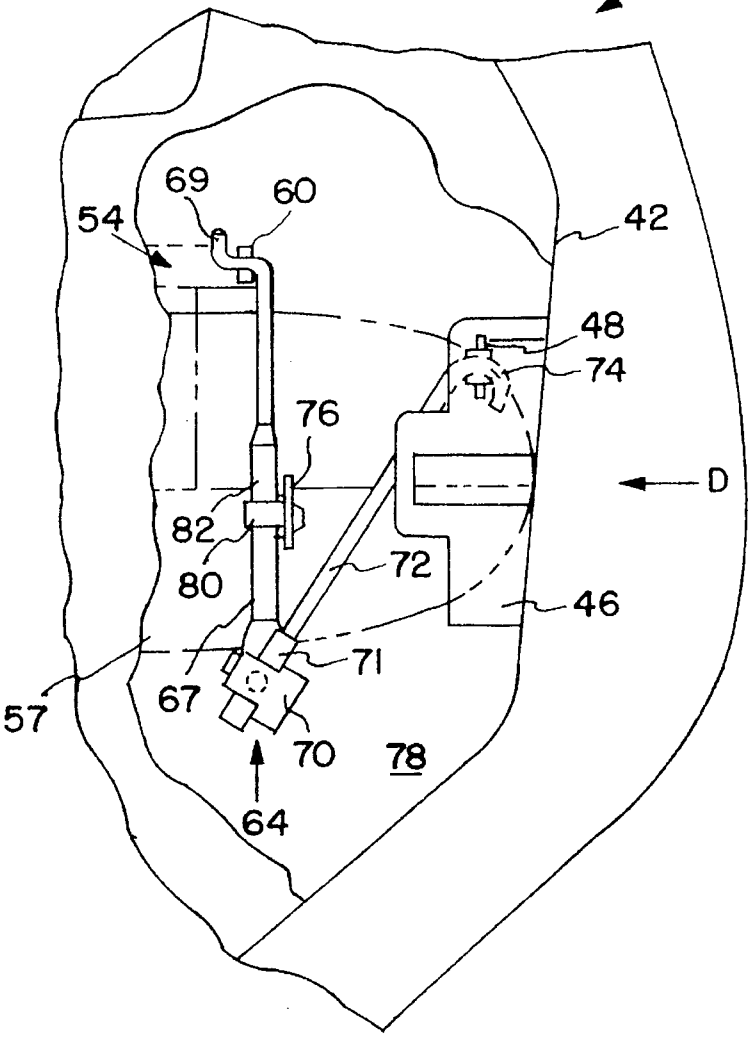
FIG. 2 is a partial side elevational view of a vehicle rear door, shown with a portion of the door interior panel removed for clarity of illustration, including a latching mechanism and releasing assembly provided in accordance with the principles of the present invention, with the latching mechanism disposed in a latching position.

With reference to FIG. 2, it can be appreciated that the motion-transmitting assembly 64 with its support tab 76 is arranged within the interior space 78 so that an accidental forward dent or deformation in the direction of arrow D of the door structure 40 due to a collision sufficient to engage and displace the motion transmitting assembly 64, will cause the motion-transmitting assembly 64 to fold, displacing the latch release rod 72 and releasing component 48 generally upwardly, since the motion-transmitting assembly 64 is supported in the interior space 78 at support tab 76, mounted forward external skin portion 79, which is forward the exterior panel 42 (FIG. 4). Thus, upward movement of the releasing component 48 ensures that the latching mechanism 46 will be maintained in its latched relation with the door opening catch after the accidental collision.

It can be seen that the present invention provides a simple and effective means of ensuring that the latching mechanism 46 remains latched with the door opening catch preventing the vehicle door from opening upon accidental deformation of the door structure.

It thus will be appreciated that the objects of this invention have been fully and effectively accomplished. It will be realized, however, that the foregoing preferred embodiment of the present invention has been shown and described for the purpose of illustrating the structural and functional principles of the present invention and is subject to change without departure from such principles. Therefore, this invention includes all the modifications encompassed within the spirit of the following claims.

What is claimed is:

1. A vehicle door comprising a door structure defining an exterior skin and an interior panel, said door structure being constructed and arranged to be pivoted at a forward end thereof and moved between open and closed positions with respect to a door opening in the vehicle, a latching mechanism carried by said door structure at a rear end portion thereof constructed and arranged to move between an unlatched relation with a door opening catch and a latched relation with the door opening catch, said latching mechanism including a movable releasing component constructed and arranged to be in a latching position within said door structure when said latching mechanism is in latched relation with the door opening catch and to be moved from said latching position in a generally downward direction into a releasing position to move the latching mechanism into unlatched relation with the door opening catch, a manually operable releasing assembly mounted on said door structure at the rear end thereof and having a manually engageable movable component disposed outwardly of said exterior skin constructed and arranged to be manually engaged and moved from an inoperative position into a releasing position, said releasing assembly including a moving component disposed within said door structure movable from an inoperative position in a generally downward direction into a releasing position in response to the manual movement of said releasing assembly from the inoperative position thereof into the releasing position thereof, a motion-transmitting assembly interconnected between a portion of said moving component and a generally horizontally spaced portion of said movable releasing component for transmitting the generally downward movement of said moving component from its inoperative position to its releasing position into a generally downward movement of said movable releasing component from its latching position into its releasing position, said motion-transmitting assembly being disposed within an interior space defined by the door structure which extends below the interconnections of said motion-transmitting assembly between said moving component and said movable releasing component, said motion-transmitting assembly being constructed and arranged within said space so that an accidental forward deformation of the door structure defining said space sufficient to displace said motion-transmitting assembly will displace the interconnection with said movable releasing component generally upwardly.

2. The vehicle door as defined in claim 1, wherein said moving component of said manually operable releasing assembly is pivotally coupled to said door structure, said motion-transmitting assembly including:

a handle release rod having first and second ends, said first end being coupled to said moving component, and a latch release rod coupled between said second end of said handle release rod and said releasing component so as to define a generally V-shaped structure, generally downward movement of said moving component from its inoperative position to its releasing position being transmitted into generally downward movement of said handle release rod and said latch release rod so as to move said releasing component into its releasing position, said door structure including a support member fixed with respect thereto and disposed inwardly of said exterior skin within said interior space, said support member being coupled to said motion-transmitting assembly and constructed and arranged to support said motion-transmitting assembly within said interior space while enabling said motion-transmitting assembly to (1) transmit the generally downward movement of the moving component into generally downward movement of said movable releasing component and (2) permit the displacement of the interconnection of said movable releasing component generally upward upon said accidental forward deformation of said door structure.

3. The vehicle door as defined in claim 2, wherein said handle release rod of said motion-transmitting assembly is coupled with said fixed support member so as to be movable with respect thereto.

4. The vehicle door as defined in claim 3, wherein said support member is disposed about a portion of a periphery of said handle release rod such that said handle release rod is supported thereby for reciprocating movement therewith.

5. The vehicle door as defined in claim 2, wherein said latch release rod is pivotally coupled to said handle release rod by a coupling member, said coupling member being constructed and arranged so as to permit adjustment of a point of coupling between said latch release rod and said handle release rod.

6. The vehicle door as defined in claim 2, wherein said movable releasing component of said latching mechanism includes an end portion defining a slot therein, an end of said latch release rod being engaged with said slot.

7. The vehicle door as defined in claim 6, wherein said end of said latch release rod is shaped in the form of a hook, said hook being disposed within said slot to couple said releasing component to said latch release rod.

8. A latching and releasing assembly for a vehicle door, the vehicle door defining a door structure having an exterior skin and an interior panel, the door structure being constructed and arranged to be pivoted at a forward end thereof and moved between open and closed positions with respect to a door opening in the vehicle, said assembly comprising:

a latching mechanism constructed and arranged to be carried by the door structure at a rear end portion thereof and to be moved between an unlatched relation with a door opening catch and a latched relation with the door opening catch, said latching mechanism including a movable releasing component constructed and arranged to be moved from a latching position, in a generally downward direction, into a releasing position to move the latching mechanism into unlatched relation with the door opening catch, a manually operable releasing assembly constructed and arranged to be mounted on said door structure at the rear end thereof and having a manually engageable movable component constructed and arranged to be disposed outwardly of the exterior skin, the manually engageable movable component being constructed and arranged to be manually engaged and moved from an inoperative position into a releasing position, said releasing assembly including a moving component constructed and arranged to be disposed within the door structure and movable from an inoperative position in a generally downward direction into a releasing position in response to the manual movement of said releasing assembly from the inoperative position thereof into the releasing position thereof, a motion-transmitting assembly interconnected between a portion of said moving component and a generally horizontally spaced portion of said movable releasing component for transmitting the generally downward movement of said moving component from its inoperative position to its releasing position into a generally downward movement of said movable releasing component from its latching position into its releasing position, said motion-transmitting assembly being constructed and arranged to be disposed within an interior space defined by the door structure which extends below the interconnections of said motion-transmitting assembly between said moving component and said movable releasing component, said motion-transmitting assembly being constructed and arranged so that when arranged within the space, an accidental forward deformation of the door structure defining the space sufficient to displace said motion-transmitting assembly will displace the interconnection with said movable releasing component generally upwardly.

9. The assembly as defined in claim 8, wherein said motion-transmitting assembly includes:

a handle release rod having first and second ends, said first end being coupled to said moving component, and a latch release rod coupled between said second end of said handle release rod and said releasing component so as to define a generally V-shaped structure, said motion-transmitting assembly being constructed and arranged to be supported by a support member of the door structure fixed with respect thereto and disposed inwardly of the exterior skin within the interior space, one of said handle release rod and said latch release rod being constructed and arranged to be coupled to the support member so as to enable said motion-transmitting assembly to (1) transmit the generally downward movement of the moving component into generally downward movement of said movable releasing component and (2) permit the displacement of the interconnection of said movable releasing component generally upward upon said accidental forward deformation of the door structure when disposed therein.

10. The assembly as defined in claim 9, wherein said handle release rod is constructed and arranged to be coupled with the support member so as to be movable with respect thereto.

11. The assembly as defined in claim 9, wherein said latch release rod is pivotally coupled to said handle release rod by a coupling member, said coupling member being constructed and arranged so as to permit adjustment of a point of coupling between said latch release rod and said handle release rod.

12. The assembly as defined in claim 8, wherein said movable releasing component of said latching mechanism includes an end portion defining a slot therein, an end of said latch release rod being engaged with said slot.

13. The assembly as defined in claim 12, wherein said end of said latch release rod is shaped in the form of a hook, said hook being disposed within said slot to couple said releasing component to said latch release rod.

* * * * *